US008539893B2

(12) United States Patent
Tokura

(10) Patent No.: US 8,539,893 B2
(45) Date of Patent: Sep. 24, 2013

(54) SEWING MACHINE AND COMPUTER-READABLE MEDIUM STORING SEWING MACHINE CONTROL PROGRAM

(75) Inventor: Masashi Tokura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 677 days.

(21) Appl. No.: 12/857,147

(22) Filed: Aug. 16, 2010

(65) Prior Publication Data

US 2011/0048301 A1 Mar. 3, 2011

(30) Foreign Application Priority Data

Sep. 3, 2009 (JP) ..... 2009-203649

(51) Int. Cl.
*D05C 7/04* (2006.01)

(52) U.S. Cl.
USPC ..... 112/103; 112/102.5; 112/470.01; 112/470.06

(58) Field of Classification Search
USPC ..... 112/102.5, 103, 445, 470.01, 470.03, 112/470.04, 470.06, 475.18, 475.19; 700/136–138
See application file for complete search history.

(56) References Cited

U.S. PATENT DOCUMENTS 4,998,489 A * 3/1991 Hisatake et al. ..... 112/103
5,537,945 A 7/1996 Sugihara et al.
5,553,559 A * 9/1996 Inoue et al. ..... 112/102.5
5,855,176 A * 1/1999 Takenoya et al. ..... 112/102.5
5,911,182 A 6/1999 Uyama et al.
5,943,972 A 8/1999 Hirata
6,000,350 A * 12/1999 Koike et al. ..... 112/102.5
6,167,822 B1 1/2001 Miyasako et al.
7,155,302 B2 * 12/2006 Muto et al. ..... 700/138
7,290,492 B2 11/2007 Watanabe et al.
7,702,415 B2 * 4/2010 Roos ..... 700/138
7,854,207 B2 12/2010 Kuki et al.
2006/0096510 A1 * 5/2006 Kuki et al. ..... 112/102.5

(Continued)

FOREIGN PATENT DOCUMENTS

JP U-58-117795 8/1983
JP A-63-177894 7/1988

(Continued)

OTHER PUBLICATIONS

U.S. Appl. No. 12/659,224, filed Mar. 1, 2010, in the name of Masashi Tokura.

(Continued)

*Primary Examiner* — Nathan Durham
(74) *Attorney, Agent, or Firm* — Oliff & Berridge, PLC

(57) ABSTRACT

A sewing machine includes a transfer device that includes a carriage to which an embroidery frame can be attached under a plurality of attaching conditions and that is adapted to transfer the carriage, a sewing device that moves a needle bar up and down, a specification device that specifies an embroidery pattern to be sewn, an allocation device that allocates pattern data to one of the plurality of attaching conditions, a data acquisition device that acquires pattern data allocated to a current condition, an image capture device that is adapted to capture an image of at least one marker, a computation device that computes a difference as a correcting condition based on image data, a correction device that corrects the pattern data, and a sewing control device that performs sewing of the partial pattern by controlling the transfer device and the sewing device in accordance with the pattern data.

6 Claims, 13 Drawing Sheets

(56) References Cited

U.S. PATENT DOCUMENTS

| | | | |
|---|---|---|---|
| 2007/0199492 | A1 | 8/2007 | Ishii |
| 2009/0020054 | A1 | 1/2009 | Taguchi et al. |
| 2009/0188413 | A1 | 7/2009 | Hirata et al. |
| 2009/0188414 | A1 | 7/2009 | Tokura |

FOREIGN PATENT DOCUMENTS

| | | |
|---|---|---|
| JP | H-5-38703 | 9/1993 |
| JP | A-6-205885 | 7/1994 |
| JP | A-6-339588 | 12/1994 |
| JP | A-7-255968 | 10/1995 |
| JP | A-10-137467 | 5/1998 |
| JP | A-11-99294 | 4/1999 |
| JP | A-11-229262 | 8/1999 |
| JP | A-11-244561 | 9/1999 |
| JP | A-2003-71176 | 3/2003 |
| JP | A-2004-180993 | 7/2004 |
| JP | A-2005-74117 | 3/2005 |
| JP | A-2006-130124 | 5/2006 |
| JP | A-2007-105138 | 4/2007 |
| JP | A-2009-22400 | 2/2009 |
| JP | A-2009-172119 | 8/2009 |
| JP | A-2009-172123 | 8/2009 |
| WO | WO 2009/085005 A1 | 7/2009 |

OTHER PUBLICATIONS

U.S. Appl. No. 12/847,527, filed Jul. 30, 2010, in the name of Masashi Tokura.

U.S. Appl. No. 12/847,540, filed Jul. 30, 2010, in the name of Masashi Tokura.

European Search Report issued in European Application No. 10153687.8 on Jul. 15, 2011.

Japanese Office Action issued in Japanese Application No. 2009-203649 on Jul. 26, 2011 (with translation).

Japanese Office Action issued in Japanese Patent Application No. 2009-203638 (with translation).

* cited by examiner

SEWING MACHINE AND COMPUTER-READABLE MEDIUM STORING SEWING MACHINE CONTROL PROGRAM

CROSS-REFERENCE TO RELATED APPLICATION

This application claims priority to Japanese Patent Application No. 2009-203649, filed Sep. 3, 2009, the content of which is hereby incorporated herein by reference in its entirety.

BACKGROUND

The present disclosure relates to a sewing machine that has a function to sew an embroidery pattern on a work cloth that is held by an embroidery frame, and to a computer-readable medium that stores a sewing machine control program.

A sewing machine is known that has a function to sew an embroidery pattern on a work cloth that is held by an embroidery frame. The known sewing machine includes an embroidery frame that holds the work cloth, a carriage which the embroidery frame can be attached to and be detached from, and a transfer device that transfers the carriage in two directions. In recent years, there has been a demand for a sewing machine that can sew a larger embroidery pattern. On the other hand, there is a demand to reduce the size of the sewing machine. Here, a sewing machine has been proposed that includes an embroidery frame provided with a plurality of attaching portions, and that allows a position of attaching of the embroidery frame to a carriage to be changed. In such a sewing machine, partial patterns, which an embroidery pattern has been divided into according to attaching positions of the embroidery frame, can be sequentially sewn so that the embroidery pattern can be sewn. Thus a sewing area becomes substantially larger without any change to the size of the sewing machine.

SUMMARY

In the known sewing machine, when the embroidery frame is attached to the carriage at differing positions and angles, an attaching error may occur. In such a case, relative positions between the partial patterns may be unintentionally altered, and the appearance of the embroidery pattern may be impaired.

Various exemplary embodiments of the broad principles derived herein provide a sewing machine and a computer-readable medium that stores a sewing machine control program that are capable of matching positions of partial patterns in a case in which at least one of an attaching position and an attaching angle of an embroidery frame is changed in relation to a carriage and an embroidery pattern is sewn.

Exemplary embodiments provide a sewing machine that has a function to sew an embroidery pattern. The sewing machine includes a transfer device that includes a carriage to which an embroidery frame that holds a work cloth can be attached under a plurality of attaching conditions and that is adapted to transfer the carriage, the plurality of attaching conditions mutually differing in at least one of an attaching position and an attaching angle of the embroidery frame in relation to the carriage, a sewing area being set for the embroidery frame based on a movable range of the embroidery frame, and the embroidery frame being attached to the carriage in a state in which one of the plurality of attaching conditions is changed to another one of the plurality of the attaching conditions in a process in which an embroidery pattern is sewn in a case in which the embroidery pattern is larger than the sewing area, and a sewing device that moves a needle bar, to a bottom end of which a needle can be attached, up and down. The sewing machine further includes a specification device that specifies an embroidery pattern to be sewn on the work cloth, an allocation device that allocates pattern data to one of the plurality of attaching conditions, the pattern data being data used to sew each of partial patterns that are parts of the specified embroidery pattern, and the attaching conditions to which the pattern data are allocated being mutually different, a data acquisition device that acquires pattern data allocated to a current condition by the allocation device in accordance with the current condition, the current condition being an attaching condition which is one of the plurality of attaching conditions and under which the embroidery frame is currently attached, and an image capture device that is adapted to capture an image of at least one marker that is provided on the embroidery frame attached to the carriage, the image being captured before and after the current condition is changed. The sewing machine also includes a computation device that computes a difference as a correcting condition based on image data generated by the image capture device, the difference being a difference between at least one of positions of the at least one marker and angles of the at least one marker in relation to the carriage before and after the current condition is changed, a correction device that corrects the pattern data acquired by the data acquisition device by determining a position and an angle of the partial pattern in relation to the carriage based on the correcting condition computed by the computation device, and a sewing control device that performs sewing of the partial pattern by controlling the transfer device and the sewing device in accordance with the pattern data corrected by the correction device.

Exemplary embodiments further provide a computer-readable medium storing a control program executable on a sewing machine that has a function to sew an embroidery pattern. The program includes instructions that cause a computer to perform the steps of specifying an embroidery pattern to be sewn on a work cloth held by an embroidery frame that can be attached to a carriage under a plurality of attaching conditions, the plurality of attaching conditions mutually differing in at least one of an attaching position and an attaching angle of the embroidery frame in relation to the carriage, a sewing area being set for the embroidery frame based on a movable range of the embroidery frame, and the embroidery frame being attached to the carriage in a state in which one of the plurality of attaching conditions is changed to another one of the plurality of the attaching conditions in a process in which an embroidery pattern is sewn in a case in which the embroidery pattern is larger than the sewing area, allocating pattern data to one of the plurality of attaching conditions, the pattern data being data used to sew each of partial patterns that are parts of the specified embroidery pattern, and the attaching conditions to which the pattern data are allocated being mutually different, and acquiring pattern data allocated to a current condition in accordance with the current condition, the current condition being an attaching condition which is one of the plurality of attaching conditions and under which the embroidery frame is currently attached. The program further includes instructions that cause a computer to perform the steps of computing a difference as a correcting condition based on image data, the image data being generated by capturing an image of at least one marker that is provided on the embroidery frame attached to the carriage, the image being captured before and after the current condition is changed, and the difference being a difference between at least one of positions of the at least one marker and angles of the at least one marker in relation to the carriage before and after the current condition is changed, correcting the acquired pattern data by determining a position and an angle of the partial pattern in relation to the carriage based on the computed correcting condition, and performing sewing of the partial pattern by controlling a transfer device and a sewing device in accordance with the corrected pattern data, the transfer device including the carriage and being adapted to transfer the carriage, and the sewing device moving a needle bar, to a bottom end of which a needle can be attached, up and down.

BRIEF DESCRIPTION OF THE DRAWINGS

Exemplary embodiments will be described below in detail with reference to the accompanying drawings in which.

DETAILED DESCRIPTION

Hereinafter, a multi-needle sewing machine (hereinafter referred to as the sewing machine) 1 that is an embodiment will be explained with reference to the drawings. The referenced drawings are used for explaining technical features that may be utilized in the present disclosure, and the device configurations and the like that are described are simply explanatory examples that do not limit the present disclosure to only those configurations and the like.

The physical configuration of the sewing machine 1 will be explained with reference to FIGS. 1 and 2. In the explanation that follows, in FIG. 1, the upper side, the lower side, the lower left side, the upper right side, the upper left side, and the lower right side of the page respectively indicate the upper side, the lower side, the front side, the rear side, the left side, and the right side of the sewing machine 1.

Figure 1:
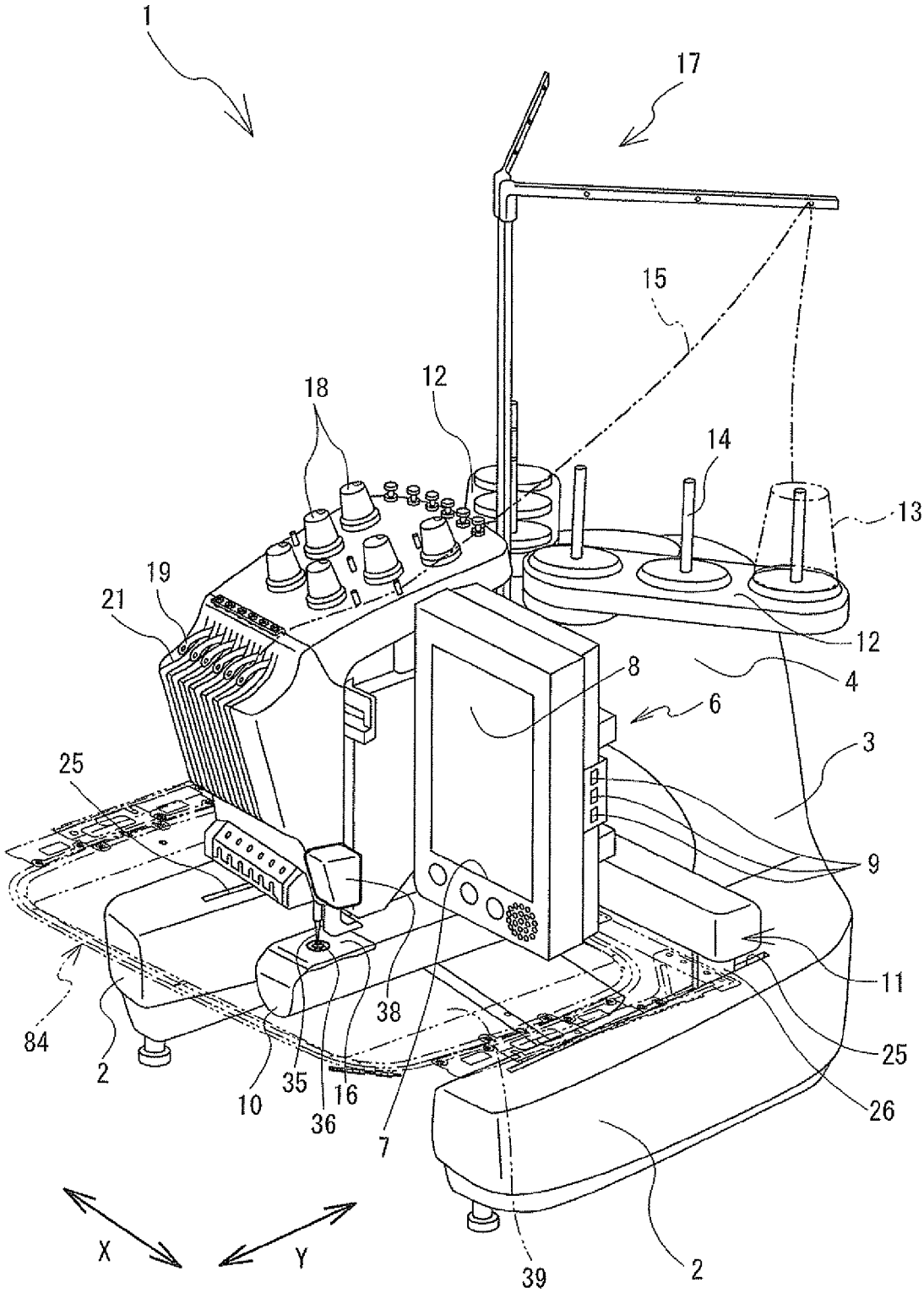
FIG. 1 is an oblique view of a multi-needle sewing machine 1.
Figure 2:
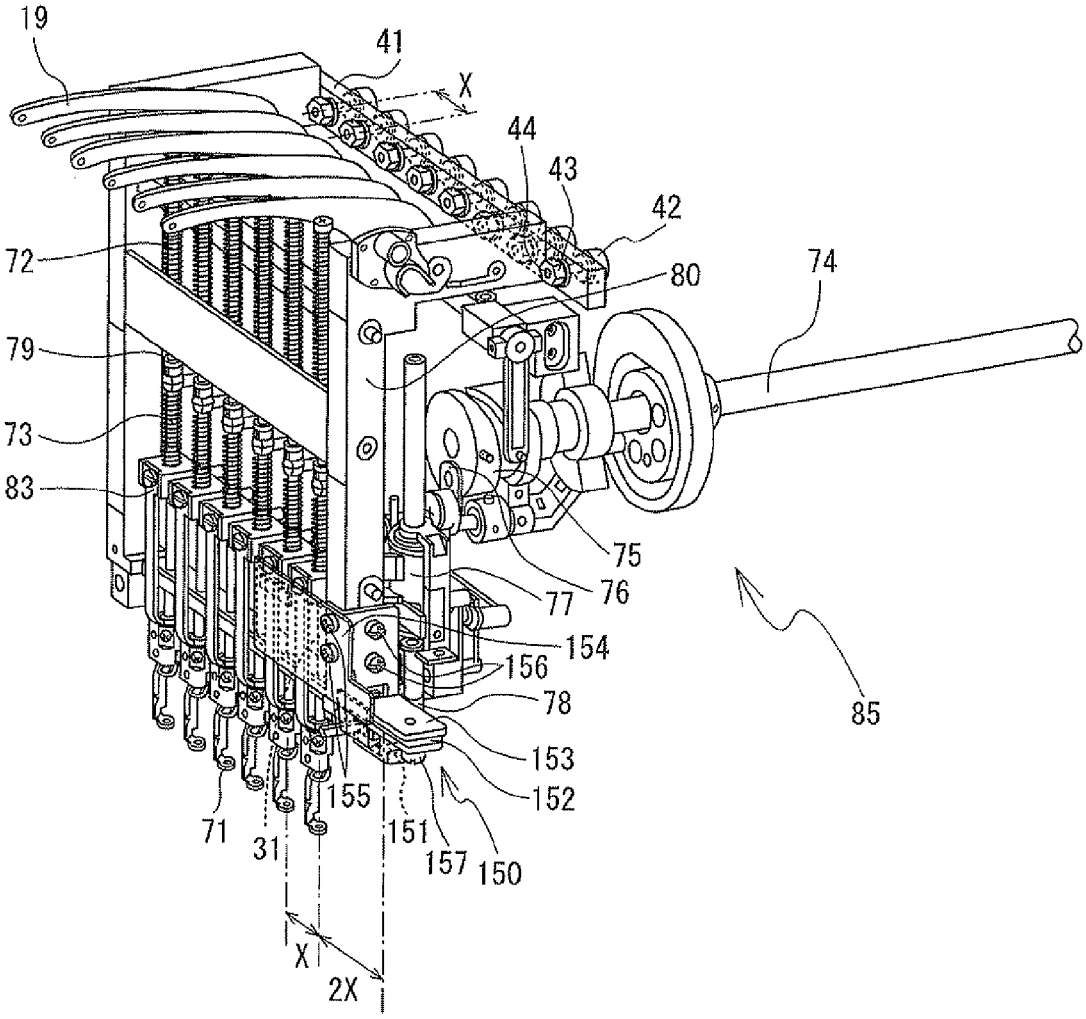
FIG. 2 is an oblique view that shows an interior of a needle bar case 21.

The sewing machine 1 includes a supporting portion 2, a pillar 3, and an arm 4 as shown in FIG. 1. The supporting portion 2 is formed in an inverted U shape in a plan view, and supports the entire sewing machine 1. A pair of left and right guide slots 25 that extend in the front-to-rear direction are provided on the top face of the supporting portion 2. The pillar 3 extends upward from the rear end of the supporting portion 2. The arm 4 extends forward from the upper end of the pillar 3. A needle bar case 21 is mounted on the front end of the arm 4 such that the needle bar case 21 can move to the left and to the right. The needle bar case 21 will be described in detail below.

An operation portion 6 is provided on the right side of the arm 4 at a central position in the front-to-rear direction. A vertically extending shaft (not shown in the drawings) serves as an axis of rotation on which the operation portion 6 is pivotally supported by the arm 4. The operation portion 6 includes a liquid crystal display (hereinafter referred to as the LCD) 7, a touch panel 8, and connectors 9. An operation screen for a user to input commands, for example, may be displayed on the LCD 7. The touch panel 8 may be used to accept commands from the user. The user can select a sewing pattern, sewing condition, and the like by using a finger, a stylus pen, or the like to perform a pressing operation (the operation hereinafter being referred to as a panel operation) on a location on the touch panel 8 that corresponds to a position on a screen that is displayed on the LCD 7 and that shows an input key or the like. The connectors 9 are USB standard connectors, to which a USB device 160 (refer to FIG. 5) can be connected.

A cylinder bed 10 that extends forward from the bottom end of the pillar 3 is provided underneath the arm 4. A shuttle (not shown in the drawings) is provided in the interior of the front end of the cylinder bed 10. A bobbin (not shown in the drawings) on which a lower thread (not shown in the drawings) is wound may be accommodated in the shuttle. A shuttle drive mechanism (not shown in the drawings) is also provided in the interior of the cylinder bed 10. The shuttle drive mechanism rotationally drives the shuttle. A needle plate 16 that is rectangular in a plan view is provided on the top face of the front end of the cylinder bed 10. A needle hole 36 through which a needle 35 passes is provided in the needle plate 16.

An embroidery frame moving mechanism 11 is provided underneath the arm 4. The sewing machine 1 performs sewing of an embroidery pattern on a work cloth 39 that is held by an embroidery frame 84 as the embroidery frame 84 is moved to the left and the right, and forward and backward, by an X axis motor 132 (refer to FIG. 5) and a Y axis motor 134 (refer to FIG. 5) of the embroidery frame moving mechanism 11. The embroidery frame moving mechanism 11 will be described in detail below.

A right-left pair of spool platforms 12 are provided at the rear face side of the top face of the arm 4. Three thread spool pins 14 are provided on each of the spool platforms 12. The thread spool pins 14 are pins that extend in the vertical direction. The thread spool pins 14 pivotally support thread spools 13. The number of the thread spools 13 that can be placed on the one pair of the spool platforms 12 is six, the same as the number of needle bars 31. Upper threads 15 may be supplied from the thread spools 13 that are attached to the spool platforms 12. Each of the upper threads 15 may be supplied, through a thread guide 17, a tensioner 18, and a thread take-up lever 19, to an eye (not shown in the drawings) of each of the needles 35 that are mounted on the bottom ends of the needle bars 31 respectively.

Next, an internal mechanism of the needle bar case 21 will be explained with reference to FIG. 2. As shown in FIG. 2, the six needle bars 31 that extend in the vertical direction are provided inside the needle bar case 21 at equal intervals X in the left-right direction. Needle bar numbers are respectively assigned to the needle bars 31 in order to identify the individual needle bars 31. In the present embodiment, the needle bar numbers 1 to 6 are assigned to the needle bars 31 in order starting from the right side in FIG. 3. The needle bars 31 are supported by two upper and lower securing members (not shown in the drawings) that are secured to a frame 80 of the needle bar case 21 such that the needle bars 31 can slide up and down. A needle bar follow spring 72 is provided on the upper half of each of the needle bars 31. A presser spring 73 is provided on the lower half of each of the needle bars 31. A needle bar guide 79 is provided between the needle bar follow spring 72 and the presser spring 73. A presser guide 83 is provided below the presser spring 73. The needle bars 31 are slid up and down by a needle bar drive mechanism 85. The needle bar drive mechanism 85 includes a sewing machine motor 122 (refer to FIG. 5), a thread take-up lever drive cam 75, a coupling member 76, a transmitting member 77, a guide bar 78, and a coupling pin (not shown in the drawings). The sewing machine motor 122 is a drive source for the needle bar drive mechanism 85. The needles 35 (refer to FIG. 1) may be attached to the bottom ends of the needle bars 31. A presser foot 71 extends from each of the presser guides 83 to slightly below the bottom end portion (the tip portion) of the corresponding needle 35. A presser foot 71 operates in conjunction with the up-and-down movement of the corresponding needle bar 31, and intermittently presses the work cloth 39 (refer to FIG. 3) downward.

An image sensor holding mechanism 150 is attached to the lower portion of the right side face of the frame 80. The image sensor holding mechanism 150 includes an image sensor 151, a holder 152, a supporting member 153, and a connecting plate 154. The image sensor 151 is a known complementary metal oxide semiconductor (CMOS) image sensor. The holder 152 supports the image sensor 151 in a state in which a lens (not shown in the drawings) of the image sensor 151 faces downward. The center of the lens of the image sensor 151 is in a position that is at a distance 2× from the needle bar 31 that is the farthest to the right. The supporting member 153 has an L shape when viewed from the front. The supporting member 153 supports the connecting plate 154 and the holder 152. The supporting member 153 is secured to the lower portion of the right side face of the frame 80 by screws 156. The holder 152 is secured to the bottom face of the supporting member 153 by a screw 157. The connecting plate 154 is a plate that is L-shaped when viewed from the front. The connecting plate 154 electrically connects the image sensor 151 to a control portion 140 that will be described below (refer to FIG. 5). The connecting plate 154 is secured to the front face of the supporting member 153 by screws 155. The front face, the top face, and the right side face of the image sensor holding mechanism 150 are covered by a cover 38 (refer to FIG. 1).

A plate 41, which extends in the right-to-left direction, is affixed to the rear edge of the upper portion of the frame 80. Eight engaging rollers 42 are respectively mounted on the rear side of the plate 41 by shoulder bolts 44. Each of the engaging rollers 42 has a round cylindrical shape, which is not shown in detail in the drawings. The engaging rollers 42 are supported by shoulder bolts 44 such that the engaging rollers 42 may revolve and such that the engaging rollers 42 cannot move in the axial direction of the engaging rollers 42. The shoulder bolts 44 are threaded into threaded holes (not shown in the drawings) in the plate 41 and secured. The tips of the shoulder bolts 44 (the tips of male threaded portions) are secured by nuts 43 such that the shoulder bolts 44 will not be loosened by the revolving of the engaging rollers 42. The intervals between the central axis lines of the engaging rollers 42 are all the same as the intervals X between the needle bars 31. The heights of mounted positions of the eight engaging rollers 42 are all the same. One of the eight engaging rollers 42 engages a helical cam (not shown in the drawings) that is provided in the front portion of the arm 4. The helical cam is rotated by a needle bar case motor 45 (refer to FIG. 5) and moves the frame 80 (the needle bar case 21) to the left and to the right. The one of the needle bars 31 with the needle bar numbers 1 to 6 and the image sensor 151 that corresponds to the engaging roller 42 that engages the helical cam is positioned directly above the needle hole 36. In a case where the engaging roller 42 that is the second from the right has engaged the helical cam, neither any of the needle bars 31 nor the image sensor 151 is positioned directly above the needle hole 36.

Figure 3:
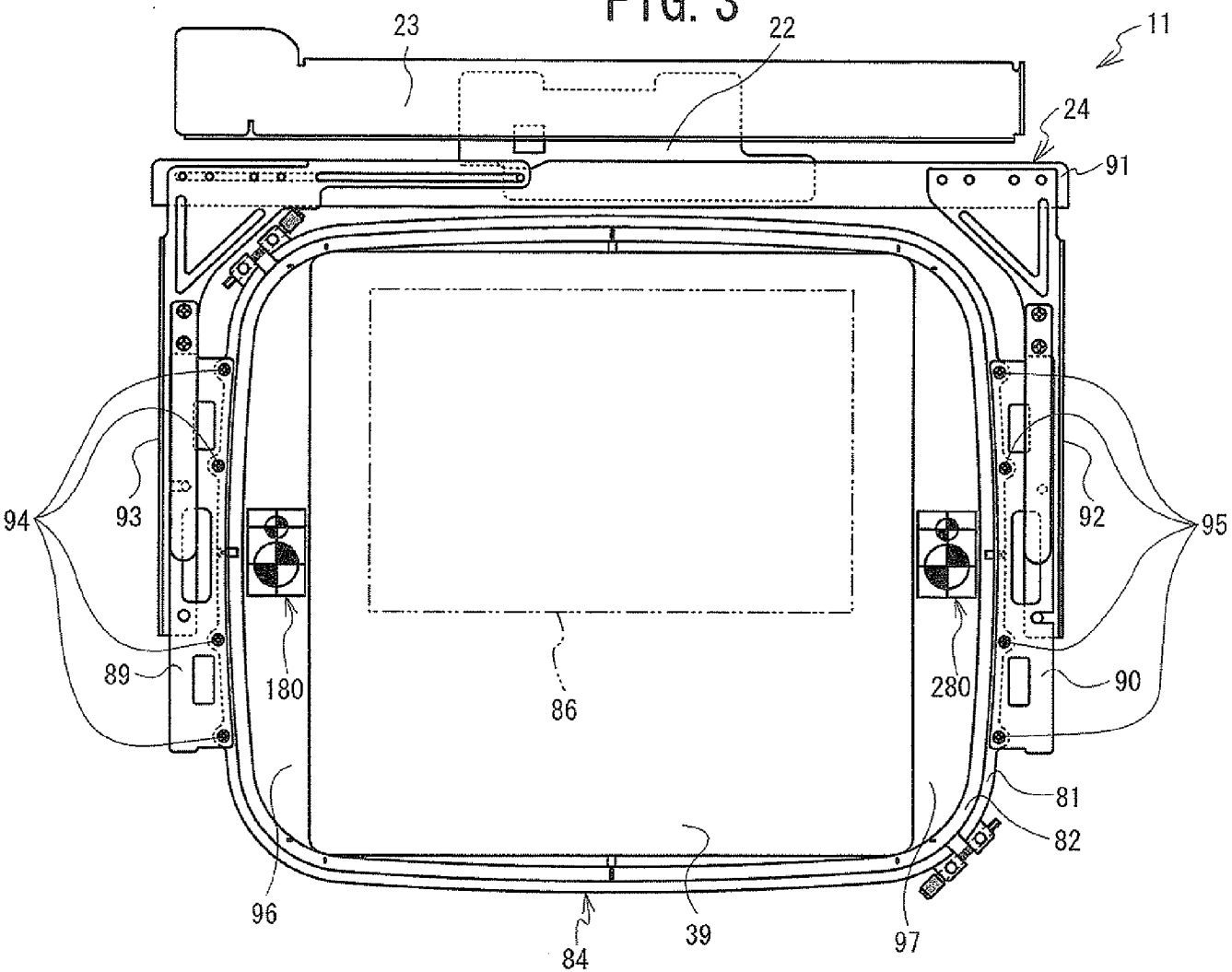
FIG. 3 is a plan view of an embroidery frame 84 and an embroidery frame moving mechanism 11.

The embroidery frame 84 and the embroidery frame moving mechanism 11 will be explained with reference to FIG. 3. The embroidery frame 84 includes an outer frame 81, an inner frame 82, and a pair of left and right coupling portions 89 and 90. The embroidery frame 84 holds the work cloth 39 between the outer frame 81 and the inner frame 82. Plate-like ribs 96 and 97 are provided on lower portions of an inner surface of the inner frame 82. A marker 180 is positioned on a central portion in the front-rear direction of an upper surface of the rib 96. A marker 280 is positioned on a central portion in the front-rear direction of an upper surface of the rib 97. The markers 180 and 280 will be explained in more detail below. The coupling portions 89 and 90 are plate members that, in a plan view, have rectangular shapes that are long in the front-rear direction. Rectangular holes are provided with each of the coupling portions 89 and 90 in three locations, namely in the front portion, the central portion, and the rear portion. The coupling portion 90 is secured to the right short side of the outer frame 81 by screws 95. The coupling portion 89 is secured to the left short side of the outer frame 81 by screws 94. In addition to the embroidery frame 84, a plurality of types of other embroidery frames that differ in both size and shape can be attached to the sewing machine 1. The embroidery frame 84 is one of the embroidery frames that can be used in the sewing machine 1, and is a rotary frame that is used when sewing an embroidery pattern that is larger than a sewing area. The sewing area is defined to be within a movable range of the embroidery frame 84 that is attached to the embroidery frame moving mechanism 11. In a case where an angle of the rotary frame is changed by 180 degrees with respect to the sewing machine 1 and the rotary frame is attached to a holder 24, positions of a sewing area 86 on the work cloth 39 that is set inside the inner frame 82 differ before and after the angle of the rotary frame is changed.

The embroidery frame moving mechanism 11 includes a holder 24, an X carriage 22, an X axis drive mechanism (not shown in the drawings), a Y carriage 23, and a Y axis drive mechanism (not shown in the drawings). The holder 24 supports the embroidery frame 84 such that the embroidery frame 84 can be attached to and detached from the holder 24. The holder 24 includes an attaching portion 91, a right arm portion 92, and a left arm portion 93. The attaching portion 91 is a plate member that is rectangular in a plan view, with its long sides running in the left-right direction. The right arm portion 92 is a plate member that extends in the front-rear direction and is secured to the right end of the attaching portion 91. The left arm portion 93 is a plate member that extends in the front-rear direction, and is attached to the left portion of the attaching portion 91. The left arm portion 93 is secured such that the position of the left arm portion 93 can be adjusted in the left-right direction in relation to the attaching portion 91. The right arm portion 92 is engaged with one of the coupling portions 89 and 90, and the left arm portion 93 is engaged with the other of the coupling portions 89 and 90.

The X carriage 22 is a plate member, with its long dimension running in the left-right direction, and a portion of the X carriage 22 projects forward from the front end of the Y carriage 23. The attaching portion 91 of the holder 24 is attached to the X carriage 22. The X axis drive mechanism includes the X axis motor 132 (refer to FIG. 5) and a linear movement mechanism (not shown in the drawings). The X axis motor 132 is a stepping motor. The linear movement mechanism includes a timing pulley (not shown in the drawings) and a timing belt (not shown in the drawings). The linear movement mechanism moves the X carriage 22 to the left and to the right (in the X axis direction) using the X axis motor 132 as its drive source.

The Y carriage 23 has a box shape, with its long dimension running in the left-right direction. The Y carriage 23 supports the X carriage 22 such that the X carriage 22 can move to the left and to the right. The Y axis drive mechanism includes a pair of left and right moving bodies 26 (refer to FIG. 1), the Y axis motor 134 (refer to FIG. 5), and a linear movement mechanism (not shown in the drawings). The moving bodies 26 are coupled to the bottom portions of the left and right ends of the Y carriage 23 respectively and pass vertically through the guide slots 25. The Y axis motor 134 is a stepping motor. The linear movement mechanism includes a timing pulley (not shown in the drawings) and a timing belt (not shown in the drawings). The linear movement mechanism moves the moving bodies 26 forward and backward (in the Y axis direction) along the guide slots 25 using the Y axis motor 134 as its drive source. In conjunction with the movement of the moving bodies 26, the Y carriage 23, which is coupled to the moving bodies 26, and the X carriage 22, which is supported by the Y carriage 23, move forward and backward (in the Y axis direction).

Next, the operation that forms a stitch on the work cloth 39 that is held by the embroidery frame 84 will be explained with reference to FIGS. 1 to 3 and 5. The embroidery frame 84 by which the work cloth 39 is held is supported by the holder 24 of the embroidery frame moving mechanism 11 (refer to FIGS. 1 and 3). First, one of the six needle bars 31 is selected by the moving of the needle bar case 21 in the left-right direction. The embroidery frame 84 is moved to a specified position by the embroidery frame moving mechanism 11. The needle bar drive mechanism 85 is driven when a drive shaft 74 is rotated by the sewing machine motor 122. The rotational movement of the drive shaft 74 is transmitted to the coupling member 76 through the thread take-up lever drive cam 75. The transmitting member 77, on which the coupling member 76 is pivotally supported, is driven up and down, being guided by the guide bar 78, which is positioned parallel to the needle bar 31. The up-and-down movement is transmitted to the needle bar 31 through the coupling pin (not shown in the drawings), and the needle bar 31, to which the needle 35 is attached, is driven up and down. Through a link mechanism, which is not shown in detail in the drawings, the thread take-up lever 19 is driven up and down by the rotation of the thread take-up lever drive cam 75. Furthermore, the rotation of the drive shaft 74 is transmitted to the shuttle drive mechanism (not shown in the drawings), and the shuttle (not shown in the drawings) is rotationally driven. Thus the needle 35, the thread take-up lever 19, and the shuttle are driven in synchronization, and a stitch is formed on the work cloth 39.

Figure 4:
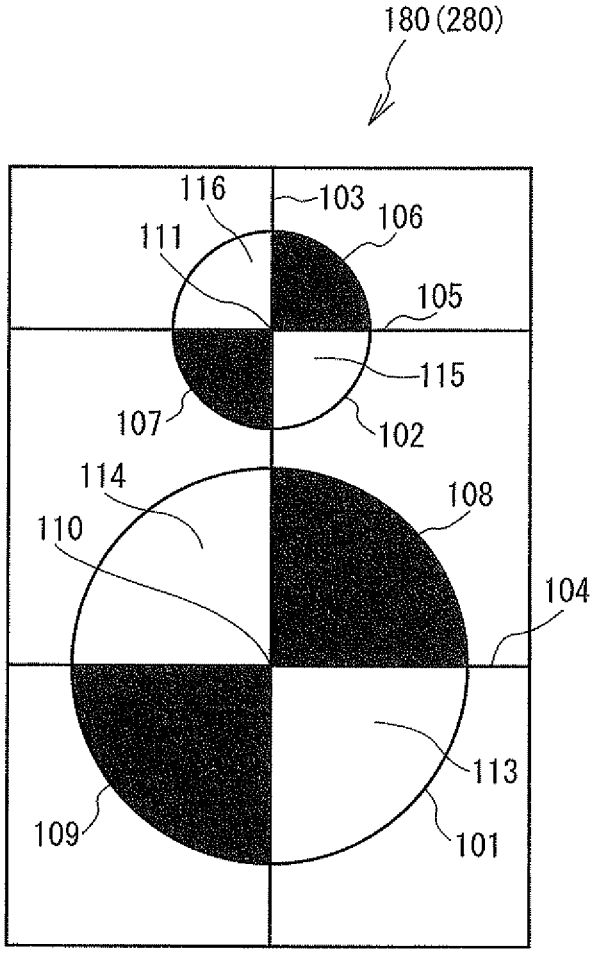
FIG. 4 is an explanatory figure of a marker 180.

The markers 180 and 280 will be explained with reference to FIG. 4. The left, right, up, and down directions in FIG. 4 respectively correspond to the left, right, up, and down directions in the marker 180. The markers 180 and 280 have the same structure, and the marker 180 will therefore be explained as an example. The marker 180 that is shown in FIG. 4 has a rectangular area that measures approximately three centimeters long by approximately two centimeters wide, and a pattern is drawn in the rectangular area. Specifically, a first circle 101 and a second circle 102 are drawn in the marker 180. The second circle 102 is disposed above the first circle 101 and has a smaller diameter than does the first circle 101. Line segments 103 to 105 are also drawn in the marker 180. The line segment 103 extends from the top edge to the bottom edge of the marker 180 and passes through a center 110 of the first circle 101 and a center 111 of the second circle 102. The line segment 104 is orthogonal to the line segment 103, passes through the center 110 of the first circle 101, and extends from the right edge to the left edge of the marker 180. The line segment 105 is orthogonal to the line segment 103, passes through the center 111 of the second circle 102, and extends from the right edge to the left edge of the marker 180.

Of the four areas that are bounded by the perimeter of the first circle 101, the line segment 103 and the line segment 104, an upper right area 108 and a lower left area 109 are filled in with black, and a lower right area 113 and an upper left area 114 are filled in with white. Similarly, of the four areas that are bounded by the second circle 102, the line segment 103 and the line segment 105, an upper right area 106 and a lower left area 107 are filled in with black, and a lower right area 115 and an upper left area 116 are filled in with white. All other parts of the surface on which the pattern of the marker 180 is drawn are not colored.

Figure 5:
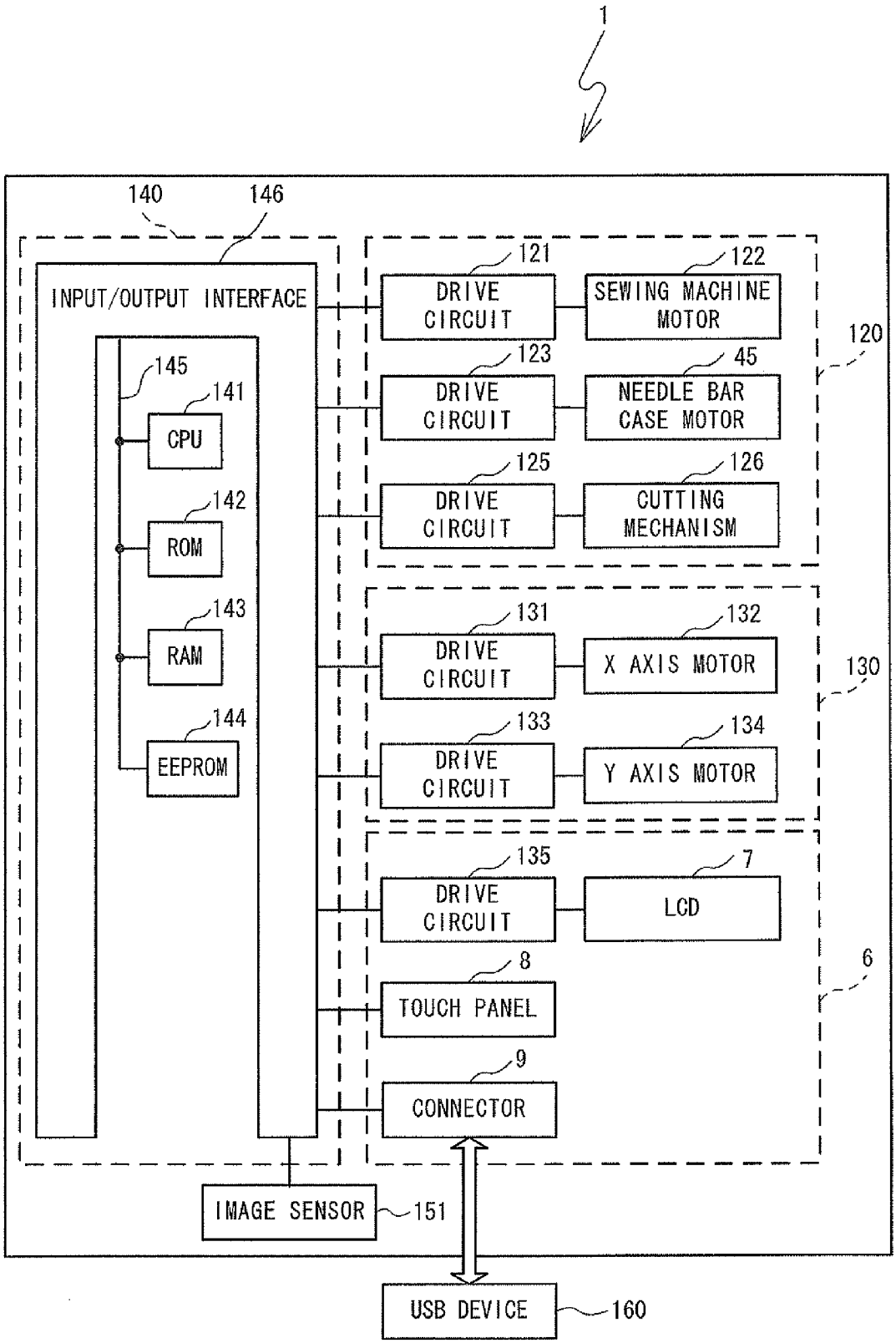
FIG. 5 is a block diagram that shows an electrical configuration of the multi-needle sewing machine 1.

Next, the electrical configuration of the sewing machine 1 will be explained with reference to FIG. 5. As shown in FIG. 5, the sewing machine 1 includes a needle drive portion 120, a sewn object drive portion 130, the operation portion 6, the image sensor 151, and the control portion 140.

The needle drive portion 120 includes drive circuits 121, 123, and 125, the sewing machine motor 122, the needle bar case motor 45, and a cutting mechanism 126. The sewing machine motor 122 moves the needle bars 31 reciprocally up and down. The drive circuit 121 drives the sewing machine motor 122 in accordance with a control signal from the control portion 140. The needle bar case motor 45 moves the needle bar case 21 to the left and to the right. The drive circuit 123 drives the needle bar case motor 45 in accordance with a control signal from the control portion 140. The cutting mechanism 126 cuts the upper threads 15 (refer to FIG. 1) that are supplied to the needles 35 (refer to FIG. 1). The drive circuit 125 drives the cutting mechanism 126 in accordance with a control signal from the control portion 140.

The sewn object drive portion 130 includes drive circuits 131 and 133, the X axis motor 132, and the Y axis motor 134. The X axis motor 132 moves the embroidery frame 84 (refer to FIG. 1) to the left and to the right. The drive circuit 131 drives the X axis motor 132 in accordance with a control signal from the control portion 140. The Y axis motor 134 moves the embroidery frame 84 forward and backward. The drive circuit 133 drives the Y axis motor 134 in accordance with a control signal from the control portion 140.

The operation portion 6 includes the touch panel 8, the connectors 9, a drive circuit 135, and the LCD 7. The drive circuit 135 drives the LCD 7 in accordance with a control signal from the control portion 140. The connectors 9 are provided with functions that connect to the USB device 160. The USB device 160 may be a personal computer, a USB memory, or another sewing machine 1, for example.

The control portion 140 includes a CPU 141, a ROM 142, a RAM 143, an EEPROM 144, and an input/output interface 146, all of which are connected to one another by a bus 145. The needle drive portion 120, the sewn object drive portion 130, the operation portion 6, and the image sensor 151 are each connected to the input/output interface 146.

The CPU 141 conducts main control over the sewing machine 1. The CPU 141 executes various types of computations and processing that relating to sewing in accordance with various types of programs that are stored in a program storage area (not shown in the drawings) in the ROM 142. The programs may be stored in an external storage device such as a flexible disk or the like.

The ROM 142 includes a plurality of storage areas that include the program storage area and a pattern storage area, which are not shown in the drawings. Various types of programs for operating the sewing machine 1, including a main program, are stored in the program storage area. The main program is a program for executing main processing that will be described below. Embroidery data (pattern data) for sewing embroidery patterns (partial patterns) are stored in the pattern storage area in association with pattern IDs. The pattern IDs are used in processing that specifies an embroidery pattern.

The RAM 143 is a storage element that can be read from and written to as desired. The RAM 143 includes storage areas that store computation results and the like from computational processing by the CPU 141 as necessary. The EEPROM 144 is a storage element that can be read from and written to. Various types of parameters for the sewing machine 1 to execute various types of processing are stored in the EEPROM 144.

Figure 6:
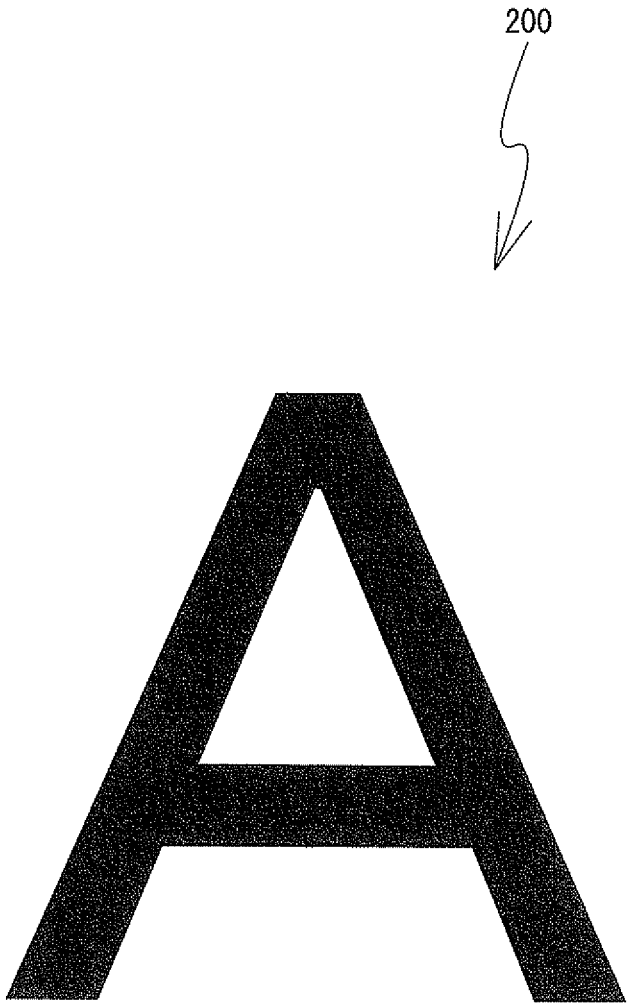
FIG. 6 is an explanatory figure of an embroidery pattern 200.
Figure 7:
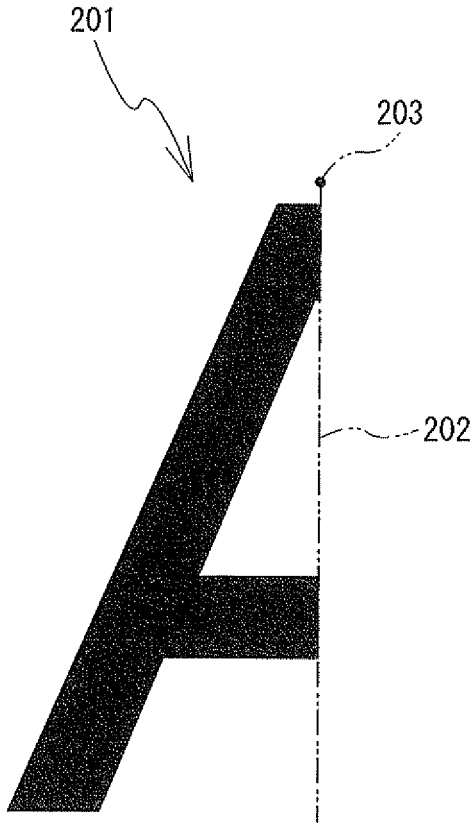
FIG. 7 is an explanatory figure of a partial pattern 201 that forms a portion of the embroidery pattern 200.

The main processing that is performed in the sewing machine 1 will be explained using as an example a case in which an embroidery pattern 200 that is shown in FIG. 6 is sewn. The embroidery pattern 200 will be explained with reference to FIGS. 6 to 8. As shown in FIG. 6, the embroidery pattern 200 is an embroidery pattern that has the shape of the character "A" drawn in a gothic font. The size of the embroidery pattern 200 is larger than the sewing area 86, and is smaller than an area inside the inner frame 82 of the embroidery frame 84. Embroidery data for the embroidery pattern 200 includes embroidery data for each of the partial pattern 201 shown in FIG. 7 and the partial pattern 211 shown in FIG. 8. The partial patterns 201 and 211 are patterns into which the embroidery pattern 200 is divided. In other words, each of the partial patterns 201 and 211 is a part of the embroidery pattern 200. The partial pattern 201 has the shape of a left half of the character "A" drawn in a gothic font. The partial pattern 211 has the shape of a right half of the character "A" drawn in a gothic font. Each of the partial patterns 201 and 211 is smaller than the sewing area 86. Dash-and-two-dot lines 202 and 212 indicate parts at which the partial patterns 201 and 211 are matched. When the partial patterns 201 and 211 are sewn such that points 203 and 213 are matched and the dash-and-two-dot lines 202 and 212 are also matched, the embroidery pattern 200 is completed. The points 203 and 213, and the dash-and-two-dot lines 202 and 212 are not sewn in actuality.

The embroidery data (pattern data) of the present embodiment will be explained. The embroidery data (the pattern data) include data on coordinates in an embroidery coordinate system. The embroidery coordinate system is a coordinate system that is set based on a coordinate system of an X axis motor 132 and a Y axis motor 134 that move the X carriage 22. The coordinate data in the embroidery coordinate system indicate the position and angle of the embroidery pattern (the partial pattern) in relation to the X carriage 22. In the present embodiment, the embroidery coordinate system is made to correspond to the actual three-dimensional coordinate system (the world coordinate system) in advance. In the embroidery coordinate system, the left-right direction of the sewing machine 1 is an X axis direction, and the front-rear direction of the sewing machine 1 is a Y axis direction. In the present embodiment, as shown in FIG. 3, in a case where the embroidery frame 84 is properly attached to the X carriage 22, the theoretical center of the sewing area 86 serves as an origin point (X, Y, Z)=(0, 0, 0) at a position that corresponds to a needle drop point. The needle drop point is the point where the needle 35 pierces the work cloth 39 when the corresponding needle bar 31 is moved downward from a state in which the needle 35 that is disposed directly above the needle hole 36 (refer to FIG. 1) is above the work cloth 39. In the present embodiment, the embroidery frame moving mechanism 11 does not move the X carriage 22 in a Z direction (the up-down direction of the sewing machine 1). Therefore, as long as the thickness of the work cloth 39 can be ignored, the top surface of the work cloth 39 is deemed to have a Z coordinate value of zero. The pattern data of the partial pattern 201 include the coordinate data of the point 203 and the coordinate data of the dash-and-two-dot line 202. In a similar manner, the pattern data of the partial pattern 211 includes the coordinate data of the point 213 and the coordinate data of the dash-and-two-dot line 212. The coordinate data of the point 203 correspond to the coordinate data of the point 213. The coordinate data of the dash-and-two-dot line 202 correspond to the coordinate data of the dash-and-two-dot line 212.

An overview of the main processing that is performed on the sewing machine 1 will be explained. In a case where the embroidery pattern 200 is sewn, first, the partial pattern 201 is sewn. Next, a command screen is displayed on the LCD 7. The command screen includes a message to prompt the attaching condition to be changed. The attaching condition may be at least one of the position and the angle of the embroidery frame 84 in relation to the X carriage 22. The attaching condition of the present embodiment is the angle of the embroidery frame 84 in relation to the X carriage 22. The user may detach the embroidery frame 84 from the holder 24. After rotating an attaching angle of the embroidery frame 84 by 180 degrees, the user may attach the embroidery frame 84 to the holder 24. Then, position matching of the partial pattern 211 to the partial pattern 201 is performed based on image data of the markers 180 and 280 that are captured before and after the attaching condition is changed. Based on results of the position matching, the partial pattern 211 is sewn in a position adjacent to the partial pattern 201.

Figure 9:
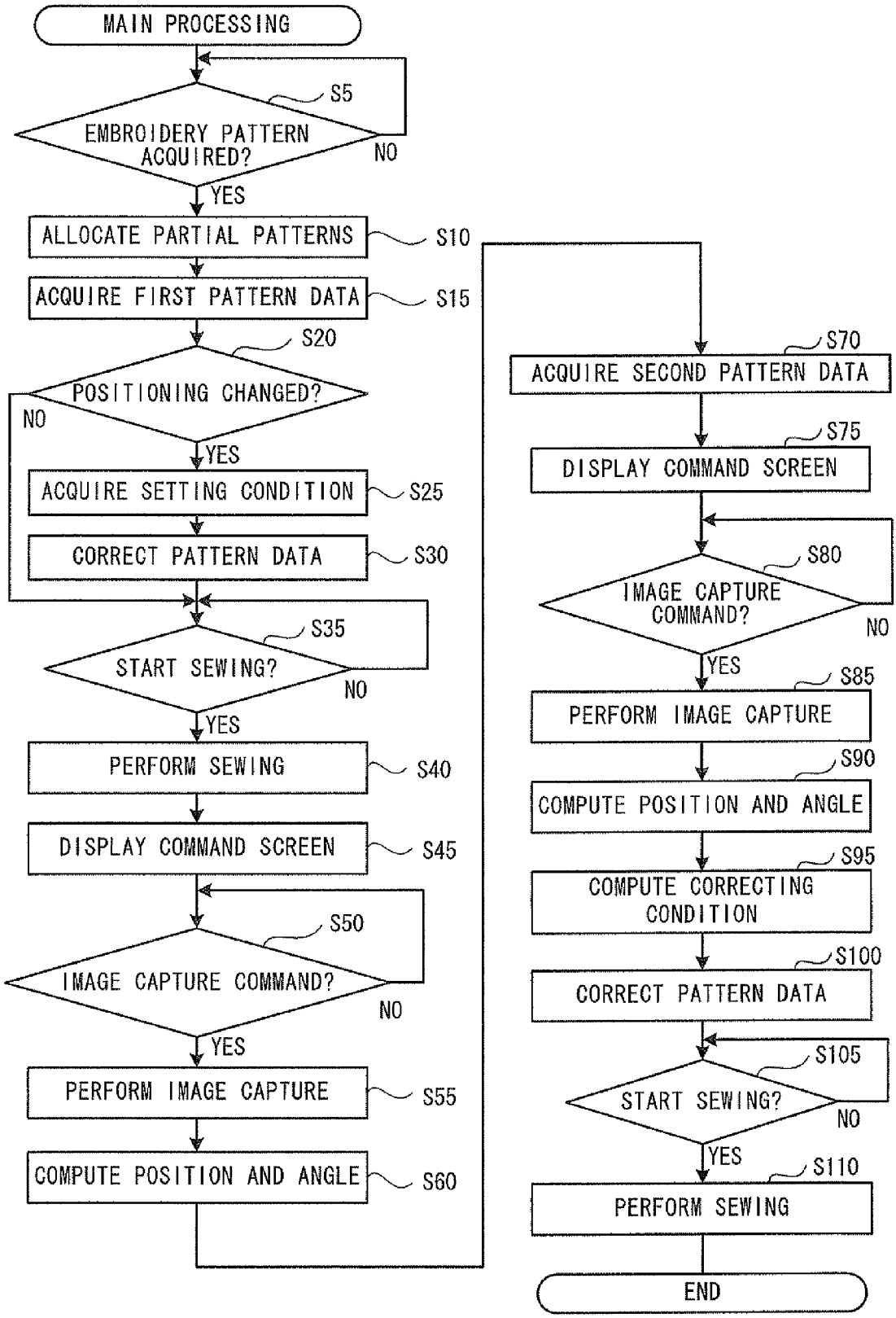
FIG. 9 is a flow chart of main processing.

The main processing on the sewing machine 1 will be explained in more detail with reference to FIG. 9. The main processing shown in FIG. 9 is performed in a case in which an embroidery pattern that is larger than the sewing area 86 is sewn using the embroidery frame 84, which is a rotary frame. The main processing shown in FIG. 9 is performed by the CPU 141 in accordance with the main program that is stored in the ROM 142.

As shown in FIG. 9, when the main processing is started, a determination is made as to whether the embroidery pattern has been acquired (Step S5). When the embroidery pattern is selected by a panel operation, for example, it is determined that the embroidery pattern has been acquired (YES at Step S5). If the embroidery pattern has not been acquired (NO at Step S5), the CPU 141 waits until the embroidery pattern is acquired. If the embroidery pattern 200 shown in FIG. 6 is acquired (YES at Step S5), the partial patterns 201 and 211 of the acquired embroidery pattern 200 are allocated to attaching conditions (Step S10). It is assumed that an initial attaching condition is a first attaching condition. It is further assumed that a second attaching condition is a attaching condition in which the attaching angle of the embroidery frame 84 in relation to the X carriage 22 is different from an attaching angle in the first attaching condition by 180 degrees. For example, the partial patterns 201 and 211 are automatically allocated to the first attaching condition and the second attaching condition, respectively. Next, the pattern data of the partial pattern 201 is acquired from the ROM 142 and the acquired pattern data is stored in the RAM 143 (Step S15).

Next, a determination is made as to whether the positioning of the embroidery pattern 200 has been changed (Step S20). A command to change the positioning is input by a panel operation, for example. The sewing machine 1 allows changing a setting for the position of the embroidery pattern and a setting for the angle in relation to the initial positioning of the embroidery pattern. If the positioning of the embroidery pattern 200 has been changed (YES at Step S20), a setting condition is acquired and the acquired setting condition is stored in the RAM 143 (Step S25). Specifically, an amount of movement ($\Delta Mx$, $\Delta My$) of a reference point and an angle of rotation $\phi$ in relation to the initial positioning of the embroidery pattern are acquired as a setting condition. The reference point may be determined as appropriate. A hypothetical point that corresponds to the origin point before the positioning is changed may be used as the reference point, for example. The angle of rotation $\phi$ expresses, as a positive value, the angle in a case where the embroidery pattern has been rotated counterclockwise. Next, the pattern data are corrected, and the corrected pattern data are stored in the RAM 143 (Step S30). Specifically, the pattern data acquired at Step S15 are corrected based on the setting condition acquired at Step S25. The coordinate data included in the pattern data are defined as (x,y). The coordinate data (x,y) are corrected based on the setting condition, and corrected coordinate data (x', y') are computed. In a case where the above described hypothetical point is defined as the reference point, the coordinate data (x', y') are obtained as $(x', y')=(x \cos \phi - y \sin \phi + \Delta Mx,\ x \sin \phi + y \cos \phi + \Delta My)$.

Figure 10:
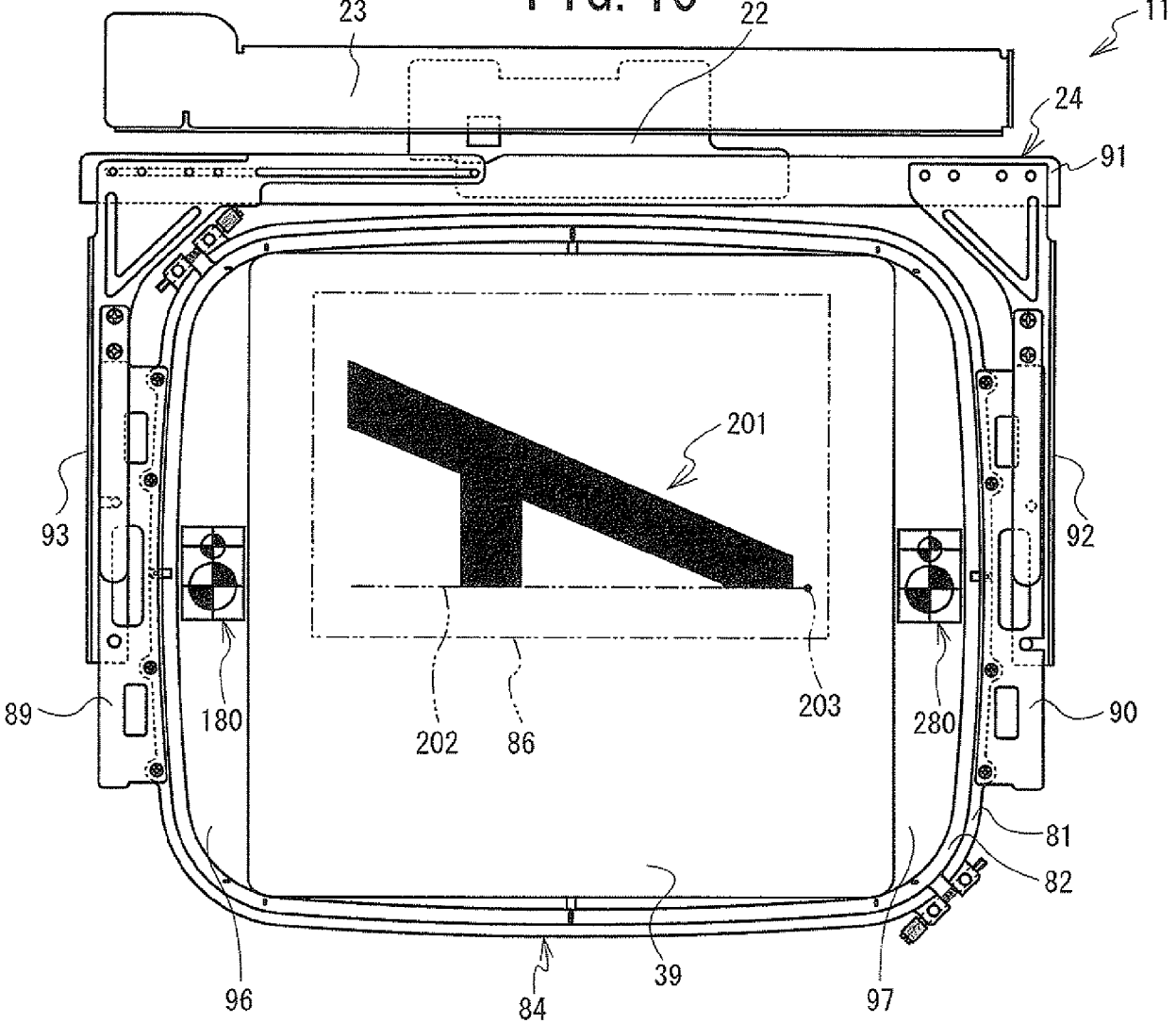
FIG. 10 is a plan view of the embroidery frame 84 and the embroidery frame moving mechanism 11 in a case where the embroidery frame 84 is attached to an X carriage 22 under a first attaching condition and the partial pattern 201 is sewn on a work cloth 39.

When the positioning of the embroidery pattern 200 has not been changed (NO at Step S20) or after the pattern data has been corrected (Step S30), a determination is made as to whether a command to start the sewing has been input (Step S35). The command to start the sewing may be input by a panel operation, for example. If the command to start the sewing has not been input (NO at Step S35), the CPU 141 waits until the command to start the sewing is input. If the command to start the sewing has been input (YES at Step S35), a partial pattern is sewn in accordance with the pattern data (Step S40). If the positioning of the embroidery pattern 200 has not been changed (NO at Step S20), the partial pattern 201 is sewn based on the pattern data acquired at Step S15. If the positioning of the embroidery pattern 200 has been changed (YES at Step S20), the partial pattern 201 is sewn based on the pattern data corrected at Step S30. Specifically, a control signal is output to the drive circuit 123 in accordance with the pattern data, and the needle bar case motor 45 is driven. This causes the needle 35, to which is supplied the upper thread 15 (refer to FIG. 1) that has the color that corresponds to the pattern data, to be positioned directly above the needle hole 36. Control signals are output to the drive circuits 131 and 133 in accordance with the pattern data, and the embroidery frame 84 is moved. A control signal is output to the drive circuit 121, and the sewing machine motor 122 is driven. This causes the needle bar 31 that is positioned directly above the needle hole 36 to move in the up and down directions. In this way, for example, as shown in FIG. 10, the partial pattern 201 is sewn on the work cloth 39.

The command screen is displayed on the LCD 7 (Step S45). A message that prompts the user to input an image capture command is displayed on the command screen. Next, the CPU 141 waits while the image capture command is not input (NO at Step S50). If the image capture command is input (YES at Step S50), the image sensor 151 captures images of the markers 180 and 280 that are positioned on the upper surface of the embroidery frame 84 one by one (Step S55). The image capture command may be input by a panel operation, for example. Specifically, first, a control signal is output to the drive circuit 123 (refer to FIG. 5), and the needle bar case 21 is moved to the position where the helical cam (not shown in the drawings) engages the engaging roller 42 that is the farthest to the right. The image sensor 151 is positioned directly above the needle hole 36 by the moving of the needle bar case 21. Next, in accordance with the embroidery coordinate system coordinates of the position of the marker 180 that are stored in the EEPROM 144, control signals are output to the drive circuits 131 and 133, and the embroidery frame 84 is moved. The marker 180 is moved to a position directly below the image sensor 151 by the moving of the embroidery frame 84. Next, an image of the marker 180 is captured by the image sensor 151, and the generated image data are stored in the RAM 143. In the same manner, an image of the marker 280 is captured, and the generated image data are also stored in the RAM 143.

A reference position and a reference angle are computed based on the image data generated at Step S55, and the computed reference position and reference angle are stored in the RAM 143 (Step S60). The reference position is defined as the coordinates (P1, Q1, R1) of the center of the first circle 101 in the marker 180. The reference angle $\theta$ is defined as the angle, in relation to the X axis, of a vector from the coordinates (P1, Q1, R1) to coordinates (P2, Q2, R2) of the center of the first circle 101 in the marker 280. The reference angle $\theta$ expresses, as a positive value, the angle of counterclockwise rotation. In the present embodiment, the Z coordinate of a point on the work cloth 39 is defined as a (fixed) value of zero. Therefore, the reference angle $\theta$ is obtained as $\theta=\tan^{-1}((Q2-Q1)/(P2-P1))$.

Figure 11:
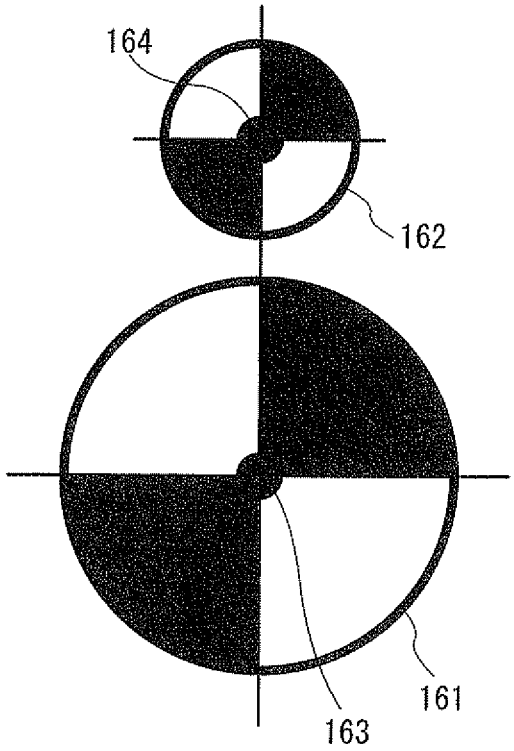
FIG. 11 is an explanatory figure of processing that detects the marker 180 based on image data of the marker 180 that are captured.

The method for computing the coordinates will be explained with reference to FIGS. 11 and 12. First, two-dimensional coordinates in an image coordinate system are computed for the first circle 101 and the second circle 102 of each of the markers 180 and 280. The image coordinate system is a coordinate system for the image captured by the image sensor 151. The two-dimensional coordinates in the image coordinate system are computed based on a position in the image. Specifically, the image data are processed by the Hough transform processing, which is a known technique, so that circumferences of circles 161 and 162 are identified, as shown in FIG. 11, for example. The coordinates of each of a center 163 of the circle 161 and a center 164 of the circle 162, and a radius of each of the circles 161 and 162 are computed. At this stage, a circle that is included in a pattern or the like of the work cloth 39 itself may be identified in addition to the first circle 101 and the second circle 102 (refer to FIG. 4) of each of the markers 180 and 280. Hereinafter, coordinates that are computed for centers of a number z of circles are indicated as (a,b) (for example, (a1, b1), (a2, b2), (a3, b3), . . . , (az, bz)). A radius that is computed for a circle is indicated as r (for example, r1, r2, r3, . . . , rz).

Figure 12:
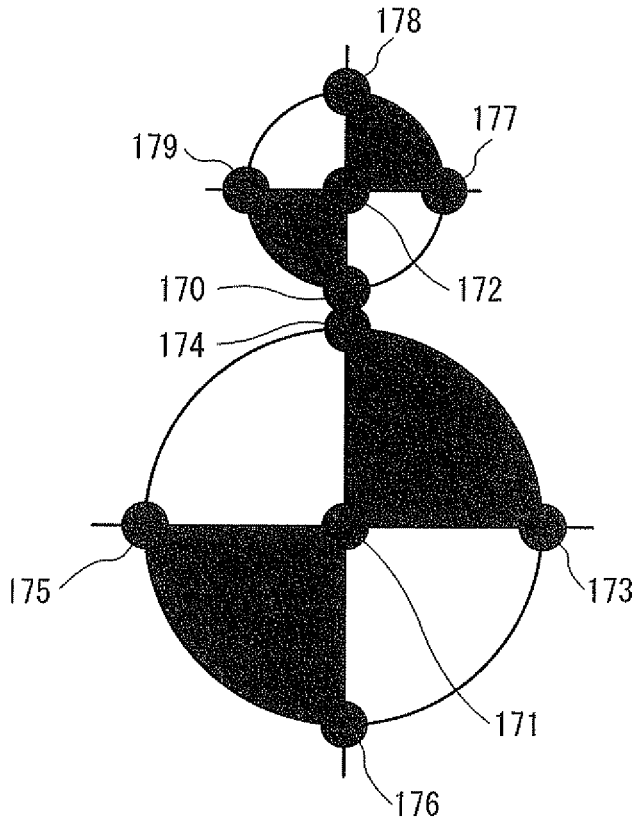
FIG. 12 is an explanatory figure of the processing that detects the marker 180 based on image data of the marker 180 that are captured.

The image data are processed by the Harris operator, which is a known technique, for example, so that coordinates 170 to 179 of corners are computed, as shown in FIG. 12. The corner refers to an intersection point at which a plurality of edges (portions that are each formed of a line, such as a contour)

intersect with each other. Hereinafter, the computed coordinates of the 10 corners are indicated as (s,t) (for example, (s1, t1), (s2, 12), . . . , (s10, s10)).

Next, the computation results for the coordinates (a,b) and the radii r are compared to the coordinates (s,t). In a case where a set of the coordinates (s,t) exists that corresponds to a set of the coordinates (a,b), and where another set of the coordinates (s,t) exists that corresponds to coordinates of a position whose distance from the set of the coordinates (a,b) is equal to a radius r, a determination is made that the set of the coordinates (s,t) that corresponds to the set of the coordinates (a,b) are the coordinates of the center of one of the first circle 101 and the second circle 102 shown in FIG. 11. Further, a determination made that the set of the coordinates (s,t) that corresponds the coordinates of the position whose distance from the set of the coordinates (a,b) is equal to the radius r is coordinates of a point where a line segment intersects the circumference of one of the first circle 101 and the second circle 102. Of sets of coordinates (a,b) that are determined to be the coordinates of the center of one of the first circle 101 and the second circle 102, coordinates corresponding to the center of the circle with a larger value of radius r are extracted as the coordinates (p,q) of the center of the first circle 101. Coordinates corresponding to the center of the circle with a smaller value of radius r are extracted as the coordinates (u,v) of the second circle 102. By performing image processing that is described above, with respect to the marker 180, the coordinates (p1, q1) of the center of the first circle 101 and the coordinates (u1, v1) of the center of the second circle 102 are assumed to be computed. Similarly, with respect to the marker 280, the coordinates (p2, q2) of the center of the first circle 101 and the coordinates (u2, v2) of the center of the second circle 102 are assumed to be computed. The markers 180 and 280 are identified by taking account of the coordinates of the center of the second circle 102 in relation to the center of the first circle 101 and by taking account of the positioning of the markers 180 and 280 on the embroidery frame 84.

Next, three-dimensional coordinate conversion processing is executed on the center coordinates that have been computed. The three-dimensional coordinate conversion processing is processing that converts the two-dimensional coordinates of the image coordinate system into the three-dimensional coordinates of the embroidery coordinate system (the world coordinate system). For example, Japanese Laid-Open Patent Publication No. 2009-172119 discloses the three-dimensional coordinate conversion processing, the relevant portions of which are incorporated by reference. In the three-dimensional coordinate conversion processing, the amount of movement of the embroidery frame 84 at Step S55 is factored into the computation of the three-dimensional coordinates of the embroidery coordinate system. The execution of the three-dimensional coordinate conversion processing causes the coordinates (P1, Q1, R1) of the center of the first circle 101 and the coordinates (U1, V1, W1) of the center of the second circle 102 to be computed for the marker 180. The coordinates (P2, Q2, R2) of the center of the first circle 101 and the coordinates (U2, V2, W2) of the center of the second circle 102 are computed for the marker 280 in the same manner.

Figure 8:
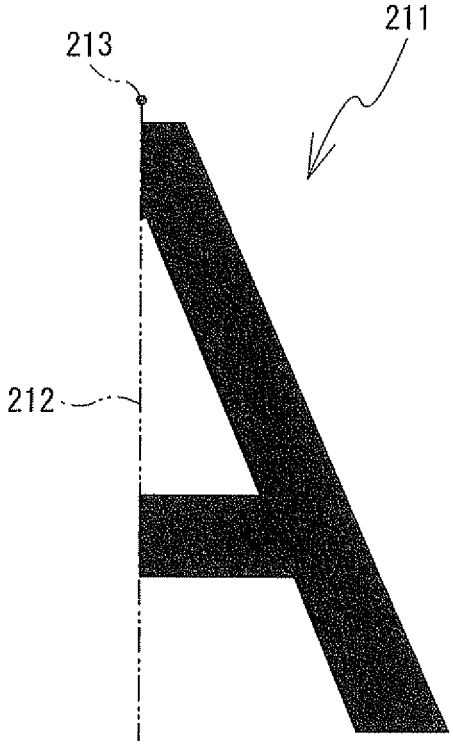
FIG. 8 is an explanatory figure of a partial pattern 211 that forms the other portion of the embroidery pattern 200.
Figure 13:
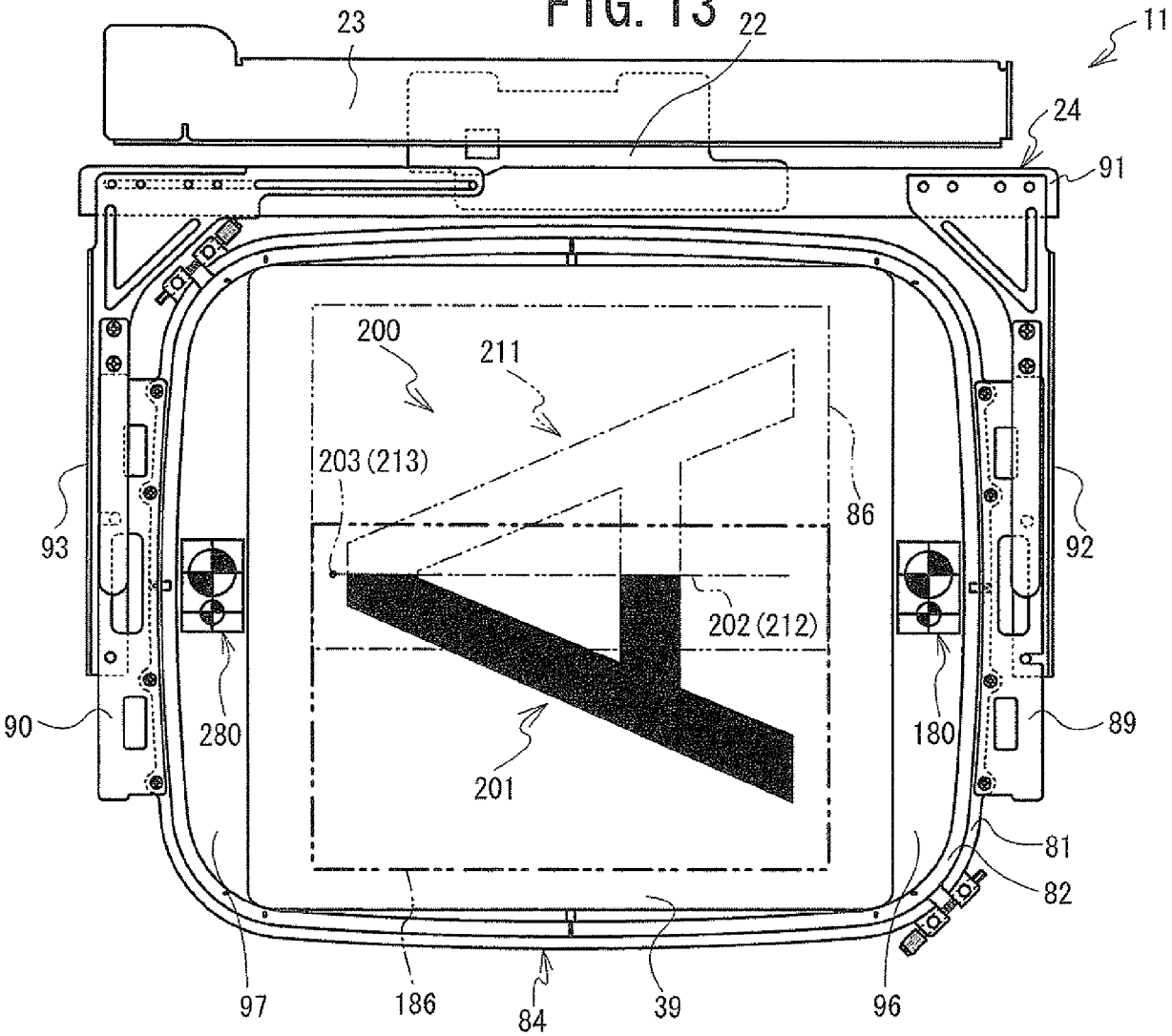
FIG. 13 is a plan view of the embroidery frame moving mechanism 11 in a case where the embroidery frame 84 is attached to the X carriage 22 under a second attaching condition.

After the reference position and the reference angle are computed (Step S60), the pattern data that is second in the sewing order are acquired from the ROM 142 and the acquired pattern data are stored in the RAM 143 (Step S70). For example, the pattern data of the partial pattern 211 shown in FIG. 8 are acquired. Next, a command screen is displayed on the LCD 7 (Step S75). A message that prompts the user to input an image capture command after changing the attaching condition of the embroidery frame 84 from the first attaching condition to the second attaching condition is displayed on the command screen. Accordingly, the user can change the attaching condition at an appropriate timing and attach the embroidery frame 84. Further, it is possible to avoid a situation in which the user forgets to change the attaching condition and attach the embroidery frame 84. Following the message on the command screen, the user may detach the embroidery frame 84 from the holder 24. The user may rotate the attaching angle of the embroidery frame 84 in relation to the X carriage 22 by 180 degrees, and then attaches the embroidery frame 84 to the holder 24 as shown in FIG. 13. As shown in FIG. 13, a sewing area 186 in a case where the embroidery frame 84 is attached to the X carriage 22 in accordance with the first attaching condition partially overlaps with a sewing area 86 in a case where the embroidery frame 84 is attached to the X carriage 22 in accordance with the current attaching condition that is the second attaching condition. A seam of the partial patterns 201 and 211 is positioned in the area of the sewing area 186 that overlaps with the sewing area 86. Next, in the same manner as the processing from Steps S50 to S60 described above, a determination is made as to whether an image capture command has been input (Step S80), image capture of the markers 180 and 280 is performed (Step S85), and the reference position and reference angle are computed (Step S90). In the processing at Step S90, the reference position and the reference angle are computed in a case where the attaching condition of the embroidery frame 84 is the second attaching condition.

A correcting condition is computed and the computed correcting condition is stored in the RAM 143 (Step S95). Specifically, an amount of position change and an amount of angle change are computed as the correcting condition. In a case where the reference angle computed at Step S60 is θ1 and the reference angle computed at Step S90 is θ2, the amount of angle change is obtained as $\Delta\theta=\theta 2-\theta 1$. In a case where coordinates of the reference position computed at Step S60 are (f1, g1, h1) and coordinates of the reference position computed at Step S90 are (f2, g2, h2), the amount of position change is obtained as $(\Delta mx, \Delta my)=(f2-f1, g2-g1)$. As described above, in the present embodiment, the Z coordinate of a point on the work cloth 39 is defined as a (fixed) value of zero. Therefore, the amount of position change on the Z axis is not computed.

The pattern data acquired at Step S70 are corrected, and the corrected pattern data are stored in the RAM 143 (Step S100). Specifically, the pattern data acquired at Step S70 are corrected based on the setting condition acquired at Step S25 and the correcting condition computed at Step S95. First, in the same manner as the processing at Step S30, the pattern data are corrected based on the setting condition acquired at Step S25. In a case where the positioning of the embroidery pattern has not been changed at Step S20, the processing to correct the pattern data is omitted. The coordinate data included in the pattern data are assumed to be (x,y). In the same manner as the processing at Step S30, in a case where the above described hypothetical point is defined as the reference point, the coordinate data (x', y') after correction are obtained as $(x', y')=(x \cos\phi-y \sin\phi+\Delta Mx, x \sin\phi+y \cos\phi+\Delta My)$. Next, the coordinate data (x', y') are corrected based on the correcting condition computed at Step S95, and coordinate data (x", y") are computed. The coordinate data (x", y") are obtained as $(x'', y'')=((x'-f2)<\cos\Delta\theta-(y'-g2)\times\sin\Delta\theta+f2+\Delta mx, (x'-f2)\times\sin\Delta\theta+(y'-g2)\times\cos\Delta\theta+g2+\Delta my)$.

The CPU 141 waits while the command to start the sewing is not input (NO at Step S105). If the command to start the sewing has been input (YES at Step S105), the partial pattern 211 is sewn in accordance with the pattern data corrected at Step S100 (Step S110). Specifically, the partial pattern 211 is sewn as shown by the dash-and-two-dot lines in FIG. 13. In FIG. 13, the point 203 matches up with the point 213 and the dash-and-two-dot line 202 matches up with the dash-and-two-dot line 212. Then, the main processing ends.

In the sewing machine 1 of the present embodiment, an embroidery pattern is sewn by dividing the embroidery pattern into a plurality of partial patterns, changing the attaching condition of the embroidery frame 84, and sewing the plurality of partial patterns, it is possible to accurately perform position matching between the partial patterns. The markers 180 and 280 are drawn in advance on the embroidery frame 84. As a result, the user does not need to prepare a marker to perform position matching of the partial patterns. In addition, the user does not need to attach a marker to the embroidery frame or to the work cloth. The positions of the markers 180 and 280 on the embroidery frame 84 are determined in advance. As a consequence, the processing to identify the markers 180 and 280 at Steps S60 and S90 is easy in comparison to a case in which the position of the markers is in a chosen position. In the sewing machine 1, the markers 180 and 280 are used to compute the reference angle. Therefore, compared to a case in which a single marker is used, the reference angle can be accurately computed. In the sewing machine 1, compared to a case in which a single marker is used, the markers 180 and 280 positioned on the embroidery frame 84 are taken as reference, and it is thus possible to more accurately determine the position and the angle of the partial pattern 211 in relation to the embroidery frame 84.

The sewing machine 1 of the present disclosure is not limited to the embodiment that is described above, and various types of modifications may be made within the scope of the present disclosure. For example, the modifications that are described below from (A) to (F) may be made as desired.

(A) The configuration of the sewing machine 1 can be modified as desired. The number of the needle bars that are provided in the sewing machine 1 may be one and may also be more than one. For example, the type and the positioning of the image sensor 151 may be modified as desired. The image sensor 151 may be an image capture element other than a CMOS image sensor, such as a CCD camera or the like, for example. The direction in which the embroidery frame moving mechanism 11 moves the X carriage 22, for example, can be modified as desired.

The sizes, the shapes, the designs, the number, and the positions of the markers can each be set as desired. The design of the markers may be any design that makes it possible to specify the markers based on the image data of the markers that are captured and acquired. For example, the colors with which the upper right area 108, the lower left area 109, and the like of the markers 180 are filled in are not limited to white and black. Any other combination of colors that provides a clear contrast may be used. The markers may be modified according to the color and the pattern of the work cloth 39, for example.

The number of the markers may be defined as desired, taking into consideration the precision of the position matching of the partial patterns and the time that is required for performing the main processing. In a case where the number of the markers is greater than one, the plurality of the markers may all be of the same type, and may also be of a plurality of types. The marker may be positioned anywhere on the embroidery frame that is attached to the X carriage 22. Even when the marker is affixed to the work cloth that is held by the embroidery frame, it is possible to perform accurate position matching between the partial patterns. The position of the marker may be established in advance, as in the present embodiment. For example, the user may affix the marker to the embroidery frame 84 in a chosen position.

(C) The embroidery pattern that is sewn in the sewing machine 1 may be modified in various ways. For example, an aggregation of a plurality of patterns may serve as a single pattern. For example, the content of the setting condition and the method for acquiring the setting condition may be modified as desired. For example, the setting conditions may be one of an amount of movement of the embroidery pattern and an angle of rotation of the embroidery pattern. The setting condition may be a rate of enlargement or reduction of the embroidery pattern, for example. Data input using a dedicated button provided on the sewing machine may be acquired as the setting condition, for example.

(D) The attaching condition may be at least one of the position and the angle of the embroidery frame in relation to the carriage. The attaching condition may be a combination of the position and the angle of the embroidery frame in relation to the carriage. For example, Japanese Laid-Open Patent Publication No. H11-229262 discloses the sewing machine that is provided with the embroidery frame for which the attaching position of the embroidery frame in relation to the carriage can be changed, the relevant portions of which are incorporated by reference.

(E) The correcting condition may be one of an amount of position change and an amount of angle change. The method of computing the correcting condition may be modified as desired depending on the type of correcting condition and the marker. For example, in a case where the amount of angle change is computed as the correcting condition based on image data of the single marker 180, the angle in relation to the X axis may be computed based on the coordinates of the center of the first circle 101 and the coordinates of the center of the second circle 102. For example, in a case where the position is computed as the correcting condition based on image data of the two markers (the markers 180 and 280), a center point of a line segment linking the centers of the first circles 101 of the markers 180 and 280 may be computed as the reference position. For example, in a case where the correcting condition is only the amount of position change, the angle of the partial pattern is not corrected according to the correcting condition at Step S100. In that case, the angle of the partial pattern is set based on the initial position of the partial pattern that is defined by the coordinate data in the pattern data and on the setting condition that is acquired at Step S25.

(F) The main processing shown in FIG. 9 can be modified as desired. For example, the partial patterns are automatically allocated to the attaching conditions at Step S10. However, a separate method may be used to allocate the partial patterns to the attaching conditions. At Step S10, the partial patterns may be allocated to the attaching conditions in accordance with a command input by a panel operation, for example.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine that has a function to sew an embroidery pattern, the sewing machine comprising:

a transfer device that includes a carriage to which an embroidery frame that holds a work cloth can be attached under a plurality of attaching conditions and that is adapted to transfer the carriage, the plurality of attaching conditions mutually differing in at least one of an attaching position and an attaching angle of the embroidery frame in relation to the carriage, a sewing area being set for the embroidery frame based on a movable range of the embroidery frame, and the embroidery frame being attached to the carriage in a state in which one of the plurality of attaching conditions is changed to another one of the plurality of the attaching conditions in a process in which an embroidery pattern is sewn in a case in which the embroidery pattern is larger than the sewing area;

a sewing device that moves a needle bar, to a bottom end of which a needle can be attached, up and down;

a specification device that specifies an embroidery pattern to be sewn on the work cloth;

an allocation device that allocates pattern data to one of the plurality of attaching conditions, the pattern data being data used to sew each of partial patterns that are parts of the specified embroidery pattern, and the attaching conditions to which the pattern data are allocated being mutually different;

a data acquisition device that acquires pattern data allocated to a current condition by the allocation device in accordance with the current condition, the current condition being an attaching condition which is one of the plurality of attaching conditions and under which the embroidery frame is currently attached;

an image capture device that is adapted to capture an image of at least one marker that is provided on the embroidery frame attached to the carriage, the image being captured before and after the current condition is changed;

a computation device that computes a difference as a correcting condition based on image data generated by the image capture device, the difference being a difference between at least one of positions of the at least one marker and angles of the at least one marker in relation to the carriage before and after the current condition is changed;

a correction device that corrects the pattern data acquired by the data acquisition device by determining a position and an angle of the partial pattern in relation to the carriage based on the correcting condition computed by the computation device; and a sewing control device that performs sewing of the partial pattern by controlling the transfer device and the sewing device in accordance with the pattern data corrected by the correction device.

2. The sewing machine according to claim 1, wherein the at least one marker includes a plurality of markers that are positioned on the embroidery frame, and the computation device computes the respective angles of the plurality of markers in relation to the carriage by using the image data of the plurality of the markers captured before and after the current condition is changed, and computes a difference between the computed angles of the plurality of markers as at least a portion of the correcting condition.

3. The sewing machine according to claim 1, further comprising:

a display device that displays an image; and a display control device that causes the display device to display a screen when the image of the at least one marker is captured by the image capture device, the screen prompting a user to change the current condition and attach the embroidery frame.

4. A non-transitory computer-readable medium storing a control program executable on a sewing machine that has a function to sew an embroidery pattern, the program comprising instructions that cause a computer to perform the steps of:

specifying an embroidery pattern to be sewn on a work cloth held by an embroidery frame that can be attached to a carriage under a plurality of attaching conditions, the plurality of attaching conditions mutually differing in at least one of an attaching position and an attaching angle of the embroidery frame in relation to the carriage, a sewing area being set for the embroidery frame based on a movable range of the embroidery frame, and the embroidery frame being attached to the carriage in a state in which one of the plurality of attaching conditions is changed to another one of the plurality of the attaching conditions in a process in which an embroidery pattern is sewn in a case in which the embroidery pattern is larger than the sewing area;

allocating pattern data to one of the plurality of attaching conditions, the pattern data being data used to sew each of partial patterns that are parts of the specified embroidery pattern, and the attaching conditions to which the pattern data are allocated being mutually different;

acquiring pattern data allocated to a current condition in accordance with the current condition, the current condition being an attaching condition which is one of the plurality of attaching conditions and under which the embroidery frame is currently attached;

computing a difference as a correcting condition based on image data, the image data being generated by capturing an image of at least one marker that is provided on the embroidery frame attached to the carriage, the image being captured before and after the current condition is changed, and the difference being a difference between at least one of positions of the at least one marker and angles of the at least one marker in relation to the carriage before and after the current condition is changed;

correcting the acquired pattern data by determining a position and an angle of the partial pattern in relation to the carriage based on the computed correcting condition; and performing sewing of the partial pattern by controlling a transfer device and a sewing device in accordance with the corrected pattern data, the transfer device including the carriage and being adapted to transfer the carriage, and the sewing device moving a needle bar, to a bottom end of which a needle can be attached, up and down.

5. The computer-readable medium according to claim 4, wherein the step of computing the correcting condition includes the steps of:

computing the respective angles of the at least one marker that includes a plurality of markers that are positioned on the embroidery frame in relation to the carriage by using the image data of the plurality of the markers captured before and after the current condition is changed; and computing a difference between the computed angles of the plurality of markers as at least a portion of the correcting condition.

6. The computer-readable medium according to claim 4, wherein the program further comprises instructions that cause the computer to perform the step of:

causing a display device to display a screen when the image of the at least one marker is captured, the screen prompting a user to change the current condition and attach the embroidery frame.

* * * * *